US010737404B2

(12) United States Patent
Storti

(10) Patent No.: US 10,737,404 B2
(45) Date of Patent: Aug. 11, 2020

(54) NAILING MACHINE FOR ASSEMBLING WOOD PALLETS OR THE LIKE

(71) Applicant: Giancarlo Storti, Frazione Solarolo Monasterolo (IT)

(72) Inventor: Giancarlo Storti, Frazione Solarolo Monasterolo (IT)

( * ) Notice: Subject to any disclaimer, the term of this patent is extended or adjusted under 35 U.S.C. 154(b) by 161 days.

(21) Appl. No.: 15/980,430

(22) Filed: May 15, 2018

(65) Prior Publication Data

US 2018/0326612 A1 Nov. 15, 2018

(30) Foreign Application Priority Data

May 15, 2017 (IT) ..... 102017000052057

(51) Int. Cl.

| | |
|---|---|
| ***B27F 7/02*** | (2006.01) |
| ***B27F 7/09*** | (2006.01) |
| ***B27M 3/00*** | (2006.01) |
| ***B65D 19/00*** | (2006.01) |
| ***B65D 19/38*** | (2006.01) |
| *B27F 7/00* | (2006.01) |

(52) U.S. Cl.

CPC ..... *B27F 7/09* (2013.01); *B27F 7/02* (2013.01); *B27M 3/0073* (2013.01); *B65D 19/0053* (2013.01); *B65D 19/38* (2013.01); *B27F 7/006* (2013.01); *B65D 2519/00029* (2013.01); *B65D 2519/00064* (2013.01); *B65D 2519/00099* (2013.01); *B65D 2519/00169* (2013.01); *B65D 2519/00273* (2013.01); *B65D 2519/00572* (2013.01); *Y10T 29/49829* (2015.01); *Y10T 29/49833* (2015.01); *Y10T 29/53317* (2015.01)

(58) Field of Classification Search

CPC ..... B27F 7/02; B27F 7/03; B27F 7/09; B27F 7/006; B27M 3/0073; Y10T 29/49829; Y10T 29/49833; Y10T 29/53317; Y10T 29/5337; Y10T 29/53435; Y10T 29/53539

USPC ..... 227/5, 7, 104, 110, 111, 152, 155, 109, 227/100, 45, 130; 29/430, 432, 772

See application file for complete search history.

(56) References Cited

U.S. PATENT DOCUMENTS

| | | | | |
|---|---|---|---|---|
| 3,557,439 A * | 1/1971 | Dykeman | ..... | B27M 3/0073 29/430 |
| 3,968,560 A * | 7/1976 | Vial | ..... | B27M 3/0073 29/430 |
| 4,168,566 A * | 9/1979 | Streckert | ..... | B27M 3/0073 227/45 |
| 4,235,005 A * | 11/1980 | James | ..... | B27M 3/0073 227/152 |

(Continued)

*Primary Examiner* — Scott A Smith

(74) *Attorney, Agent, or Firm* — Cantor Colburn LLP

(57) ABSTRACT

A nailing machine for assembling wood pallets includes a nailing station and an advancement and guiding component which form a substantially horizontal resting surface at the nailing station configured for the assembly of at least two superimposed wood pieces to be assembled by nailing to provide a pallet. The nailing station includes at least one nailing head, each of which is associated with at least one nailing stem, which can move along a substantially vertical direction with respect to the resting surface between an inactive position, in which the lower end of the nailing stem is spaced from the upper surface of the superimposed wood pieces, and an active position, in which the lower end of the nailing stem is moved closer to, or made to penetrate, the upper surface of the superimposed wood pieces.

7 Claims, 4 Drawing Sheets

(56) References Cited

U.S. PATENT DOCUMENTS

| | | | | | |
|---|---|---|---|---|---|
| 4,392,600 | A * | 7/1983 | Billett | B27M 3/0073 | 227/100 |
| 4,403,388 | A * | 9/1983 | Belcher | B27M 3/0073 | 227/40 |
| 4,441,643 | A * | 4/1984 | McCutchen | B27M 3/0073 | 227/110 |
| 4,492,016 | A * | 1/1985 | Smets | B27M 3/0073 | 227/104 |
| 4,900,329 | A | 2/1990 | Richardelli | | |
| 5,588,578 | A * | 12/1996 | Doyle | B23P 19/041 | 100/215 |
| 7,228,997 | B1 * | 6/2007 | Thompson | B27F 7/09 | 227/110 |
| 8,925,173 | B2 * | 1/2015 | Smith | B27F 7/006 | 227/109 |
| 2008/0295708 | A1 | 12/2008 | Madgar | | |

* cited by examiner

NAILING MACHINE FOR ASSEMBLING WOOD PALLETS OR THE LIKE

CROSS REFERENCE TO RELATED APPLICATIONS

This application is related to, and claims the benefit of, Italian Patent Application No. 102017000052057, filed on May 15, 2017, the contents of which are herein incorporated by reference in their entirety.

TECHNICAL FIELD

The present disclosure relates to a nailing machine for assembling wood pallets or the like.

BACKGROUND

Wood pallets are typically constituted by a loading deck, which comprises one or two layers of strips arranged side by side and superimposed so that the strips of one layer are parallel to each other and are optionally perpendicular to the strips of the other layer, and by feet or blocks or lower blocking elements designed to keep the loading deck raised with respect to the resting surface.

In many cases there are three rows of blocks and each row is composed of three blocks which are mutually spaced so as to allow the pallet to be moved by virtue of lifting means on any of its four sides.

Generally, the pallet has a rectangular plan shape and the blocks are mutually connected not only by the resting surface but also by bottom strips.

Pallet assembly operations are normally performed by using nailing machines.

One known solution provides for the use of nailing apparatuses, of an exclusively mechanical type, which are constituted by stems which can be moved along a movement direction which is vertical and perpendicular to the plane of arrangement of the lumber to be assembled, and are adapted to drive the nails into the wood bodies.

Since very often the wood pieces to be assembled have even significantly different height dimensions, if a purely mechanical nailing head is used, incorrect insertion of the nails in the lumber can occur, because the nail might either penetrate excessively into the wood or the head of the nail might remain protruding from the flat surface of the lumber.

In order to try to solve this drawback, nailing machines have been proposed which are provided with hydraulically actuated nailing heads.

Another known solution, disclosed and claimed in IT 1392697 in the name of this same Applicant, provides for the use of nailing heads for the assembly of wood pieces which have a slider for the actuation of nailing stems which can move, along a substantially vertical movement direction, by means of a linkage-crank assembly actuated by a motor.

In particular, the linkage is composed of a rod which is functionally connected to the upper rotation pivot and is provided, at its free end, with a piston body which can translate within a cylinder provided with a chamber that accommodates an elastically deformable product such as a spring or a gas.

In turn, the cylinder is connected to the lower rotation pivot of the slider.

By virtue of the presence of the elastic product inside the cylinder, the penetration of the nails does not depend only on the position of the crank as in purely mechanical classic nailing heads. In fact, by virtue of the deformable elastic product, the descending motion of the rod is limited by the thickness of the wood.

Although this constructive solution is particularly advantageous from the theoretical standpoint, it has some drawbacks, especially in terms of costs and constructive complexity.

It is in fact evident that it is necessary to act constructively on each nailing head by associating a cylinder with each linkage.

SUMMARY

The aim of the present disclosure is to provide a nailing machine that is capable of improving the background art in one or more of the aspects indicated above.

Within this aim, the disclosure provides a nailing machine for assembling wood pallets or the like which is relatively easy to provide and manage and can ensure high precision even if it operates with lumber having an uneven thickness.

The disclosure also provides a nailing machine that can adapt very simply and rapidly to different types of pallet to be assembled.

The disclosure further provides a nailing machine for assembling wood pallets or the like that is highly reliable, relatively simple to provide and at competitive costs.

This aim, as well as these and other advantages which will become better apparent hereinafter, are achieved by providing a nailing machine for assembling wood pallets or the like according to claim 1, optionally provided with one or more of the characteristics of the dependent claims.

BRIEF DESCRIPTION OF THE DRAWINGS

Further characteristics and advantages of the disclosure will become better apparent from the description of some preferred but not exclusive embodiments of the nailing machine for assembling wood pallets or the like according to the disclosure, illustrated by way of nonlimiting example in the accompanying drawings, wherein.

DETAILED DESCRIPTION OF THE DRAWINGS

Figure 1:
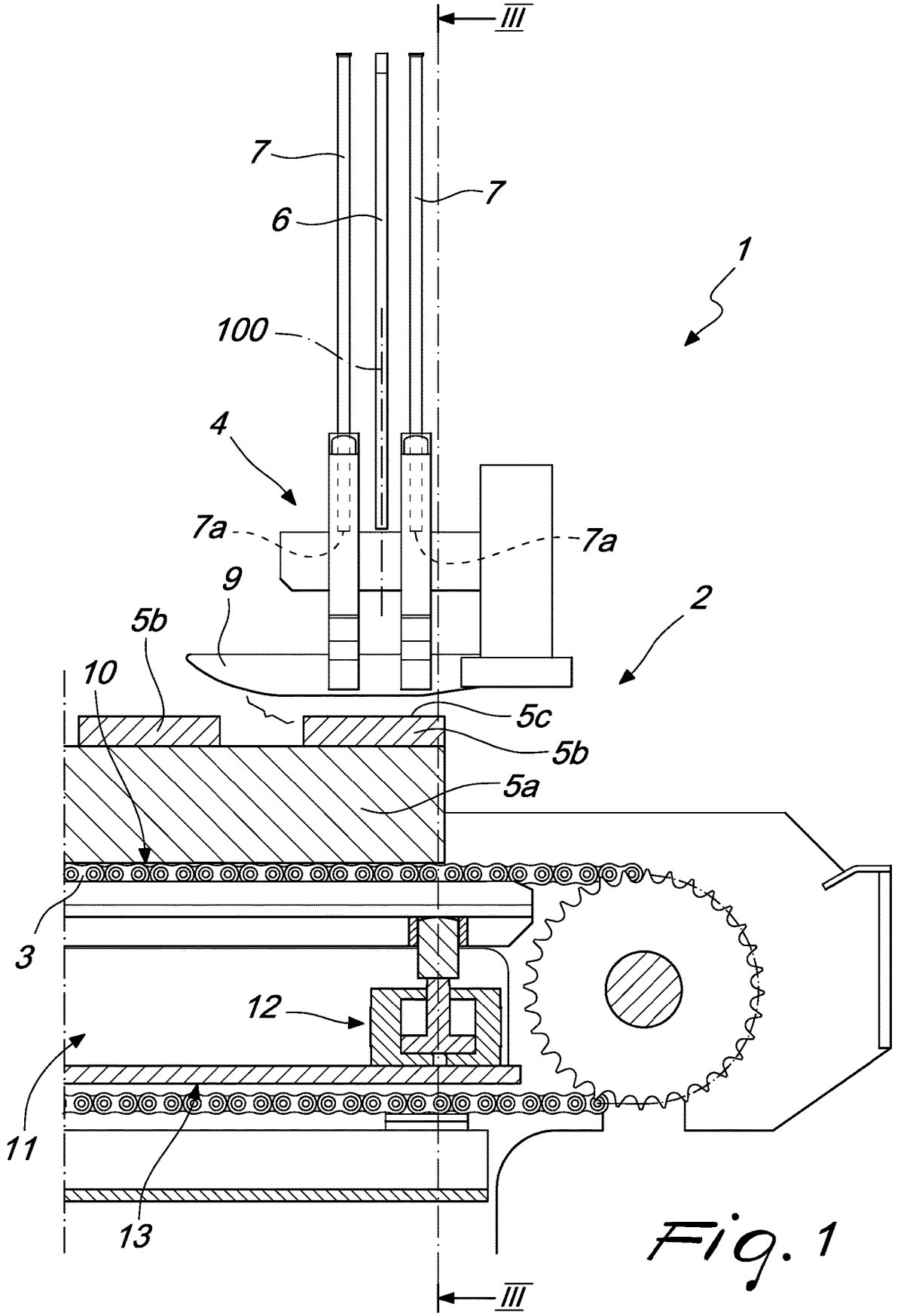
FIG. 1 is a partially sectional schematic side view of a nailing station with the nailing stems in the inactive position.

With reference to FIGS. 1-4, the nailing machine for assembling wood pallets or the like according to the disclosure, designated generally by the reference numeral 1, comprises at least one nailing station 2 and advancement and guiding means 3 which define a substantially horizontal resting surface 10 at the nailing station 2.

The nailing station 2 in particular is designed for the assembly of at least two superimposed wood pieces 5*a*, 5*b* to be assembled by nailing in order to provide a pallet.

The nailing station 2 comprises at least one nailing head 4 which is associated with at least one nailing stem 7.

Each nailing stem 7 can move along a substantially vertical direction 100 with respect to the resting surface 10 between an inactive position (shown in FIG. 1 and in FIG.

3), in which the lower end 7*a* of each nailing stem 7 is spaced from the upper surface 5*c* of the superimposed wood pieces 5*a*, 5*b*, and an active position (shown in FIG. 2 and in FIG. 4), in which the lower end 7*a* of the nailing stem 7 is moved closer to the upper surface 5*c* of the superimposed wood pieces 5*a*, 5*b*.

Of course, in the active position the lower end 7*a* of the nailing stem 7 can be made to abut against or slightly penetrate into the upper surface 5*c* of the superimposed wood pieces 5*a*, 5*b*.

In particular, the nailing head 4 can be supplied with the nails to be used for nailing.

According to the present disclosure, the nailing machine 1 comprises means for varying the elevation of the upper surface 5*c* of the two superimposed wood pieces 5*a*, 5*b* at the nailing station 2.

The means for varying the elevation of the upper surface 5*c* can be actuated on command in order to move said upper surface to a predetermined elevation.

According to a preferred embodiment, the elevation variation means comprise at least one upper abutment body 6 for a portion of the upper surface 5*c* of the two superimposed wood pieces 5*a*, 5*b*, and at least one device 11 for moving the resting surface 10.

The movement device 11 is designed to move on command the resting surface 10 between a lowered position, in which the upper surface 5*c* of the two superimposed wood pieces 5*a*, 5*b* is spaced and arranged below the upper abutment body 6, and a raised position, in which the upper surface 5*c* rests against the upper abutment body 6.

Figure 2:
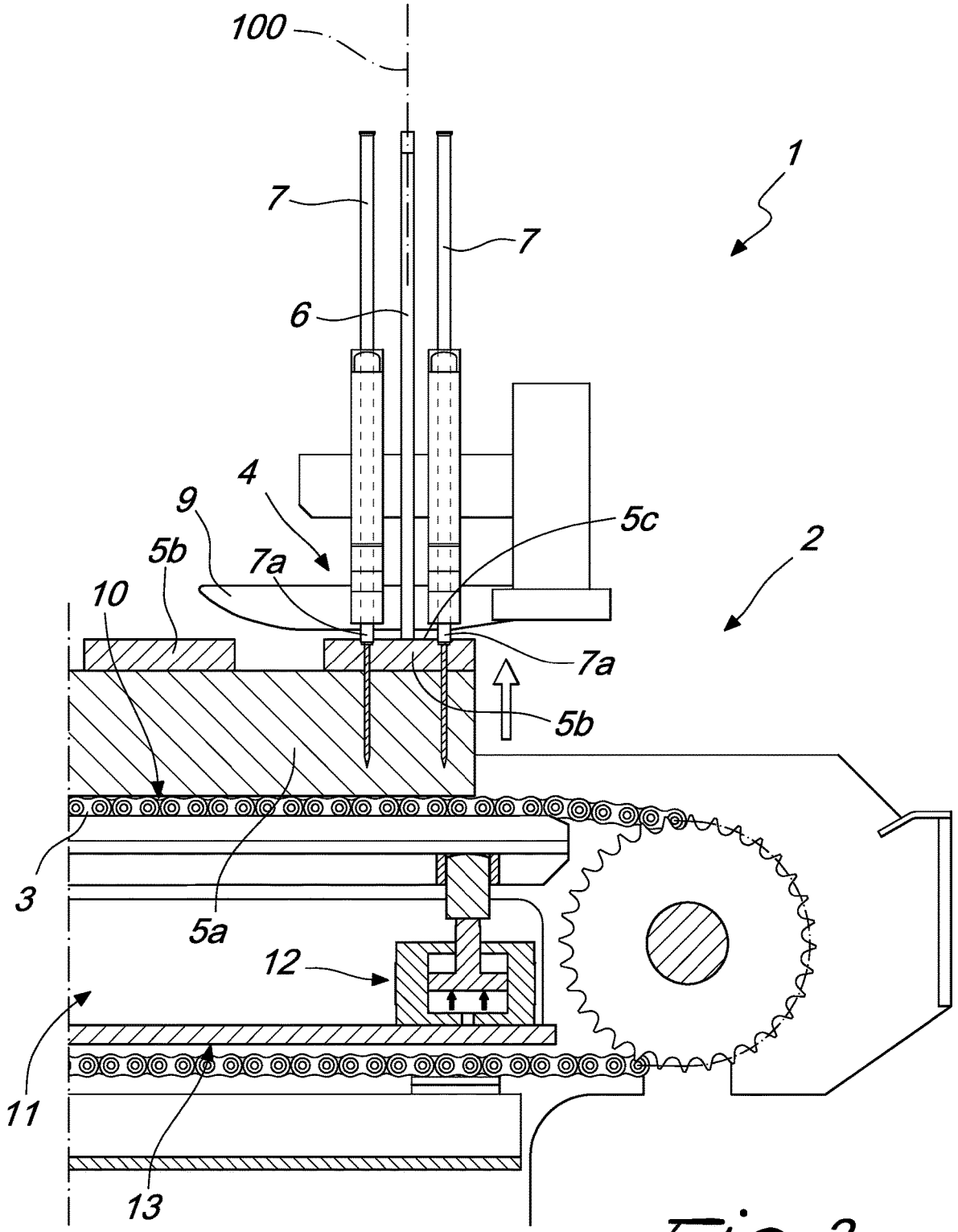
FIG. 2 is a partially sectional schematic side view of a nailing station with the nailing stems in the active position.
Figure 3:
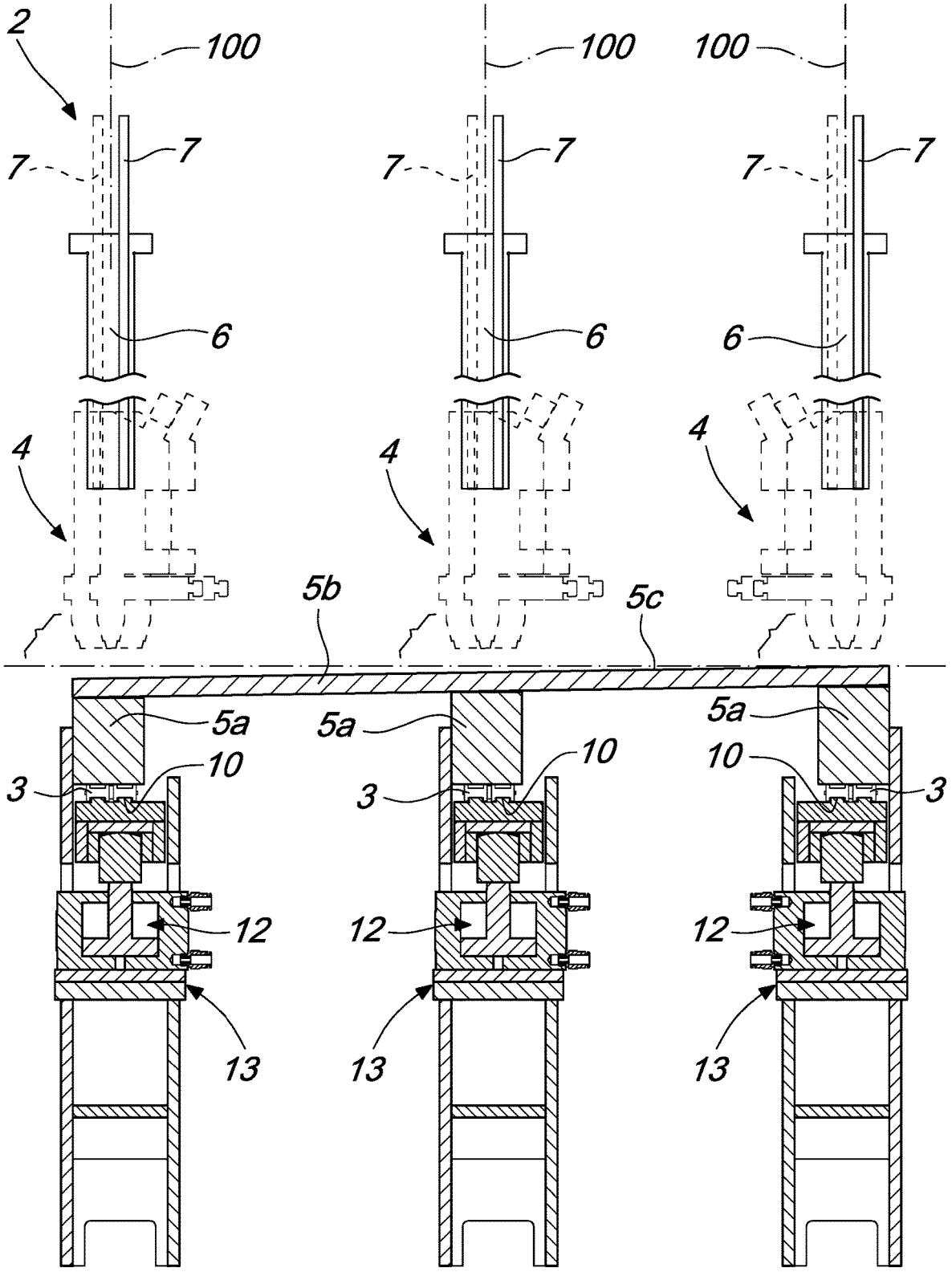
FIG. 3 is a sectional view of the nailing station, taken along the plane of arrangement defined by the line III-III of FIG. 1 with the nailing stems in the inactive position.
Figure 4:
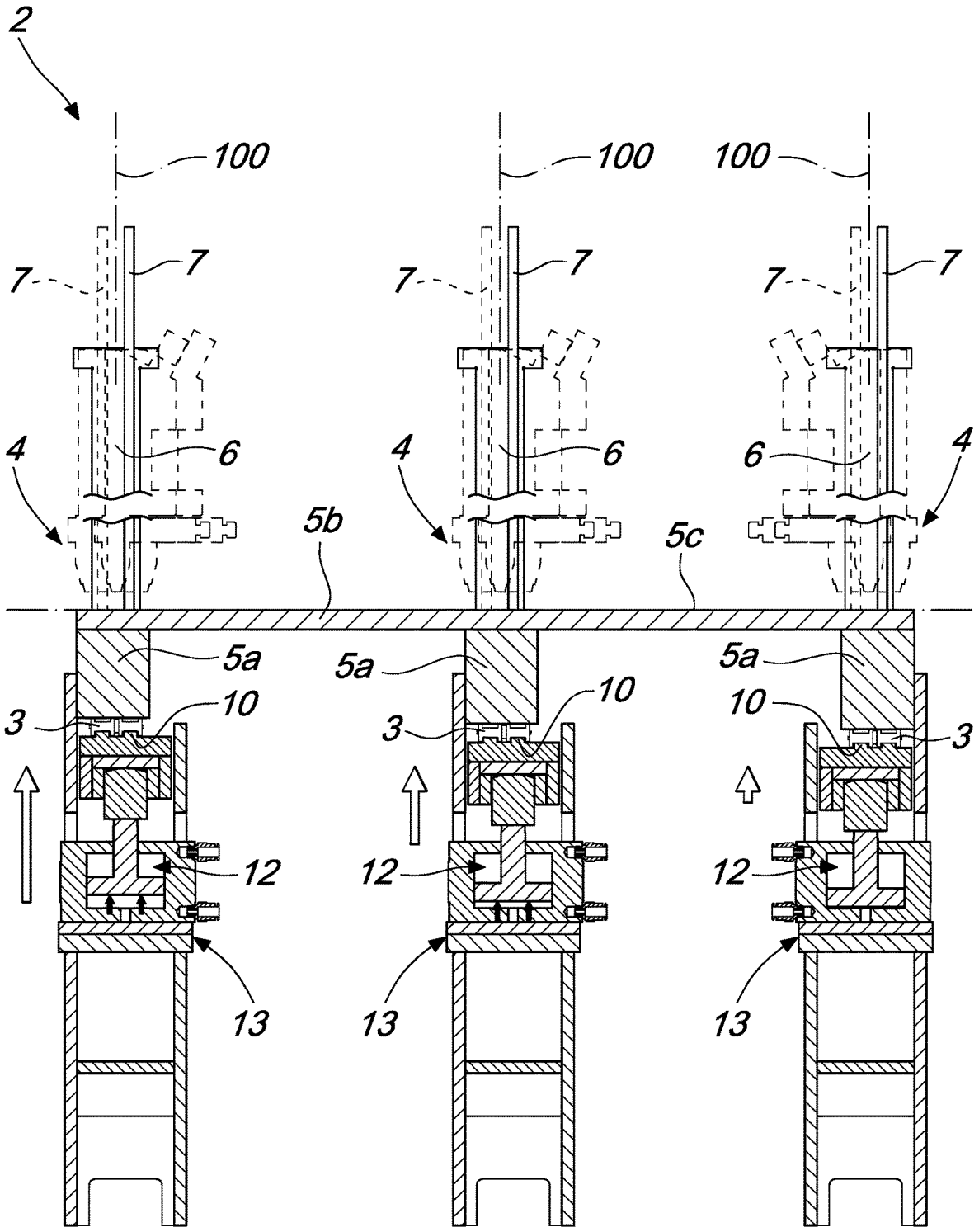
FIG. 4 is a sectional view of the nailing station, taken along the plane of arrangement defined by the line III-III of FIG. 1 with the nailing stems in the active position.

In this regard, the resting surface 10 is connected kinematically to the movement device 11 in order to pass between the lowered position (shown in FIG. 1 and in FIG. 3), and the raised position (shown in FIG. 2 and in FIG. 4).

According to a preferred embodiment, the movement means 11 comprise at least one pneumatic actuation device 12.

As an alternative, it is possible to provide different movement device 11, which has a kinematic connection element of the mechanical type (for example a motor associated with a linkage-crank assembly), associated with an elastically flexible compensation element such as for example a spring, a fluid or a gas or a compressible solid.

Moreover, as an alternative, it is possible to provide different types of movement device 11 adapted in general to stop the lifting movement of the resting surface 10 once the upper surface 5*c* abuts against the upper abutment body 6.

If the movement device 11 is associated with an electric actuation device, it is possible to provide for the interruption of movement upon reaching a predetermined level of electrical absorption of the respective electrical actuation device.

The actuation device 12 can also be of the hydraulically actuated type.

With reference to the embodiment shown in the figures, the nailing station 2 comprises at least one base structure 13.

In this case, the pneumatic actuation device 12 is interposed between the resting surface 10 and the base structure 13.

Conveniently, the or each upper abutment body 6 is connected kinematically to at least one nailing stem 7 during movement from the inactive position to the active position and vice versa.

Advantageously, the upper abutment body 6 is integral with the nailing stem or stems 7 during movement from the inactive position to the active position and vice versa.

In this manner, the upper abutment body 6 moves to a lowered position, providing an upper abutment which is capable of keeping the resting surface 10 locked in the raised position during the lowering of the nailing stems 7 and therefore during the operations for inserting the nails within the superimposed wood pieces 5*a*, 5*b*.

Nothing forbids the use of different types of upper abutment body 6, in some cases, even fixed with respect to the base structure 13 in an extreme case.

In fact, nothing forbids the upper abutment bodies 6 from being provided by fixed presser bodies 9 which can also perform a guiding function.

The nailing machine 1 conveniently comprises means for adjusting the force applied by the movement device 11 during transition from the lowered position toward the raised position.

The proposed solution allows to always obtain correct nailing since, by virtue of the movement device 11, the upper surface 5*c* is always moved into the correct nailing position with respect to the (constant) stroke of the nailing stems 7.

The presence of the upper abutment body 6, be it fixed or movable, allows to always move to the same elevation the upper surface 5*c*, regardless of the thicknesses and height of the wood pieces to be assembled 5*a*, 5*b*.

The use of pneumatic actuation devices 12, or of movement device 11 of another type (hydraulic, electrical, etc.) allows to adjust the thrust force on the resting surface 10, so as to contrast the force applied by the nails during their insertion in the wood pieces 5*a*, 5*b*.

In practice it has been found that the disclosure achieves the intended advantages by providing a nailing machine which is capable of adapting very simply and rapidly to different heights of the wood pieces to be assembled.

The disclosure thus conceived is susceptible of numerous modifications and variations; all the details may further be replaced with other technically equivalent elements.

In practice, the materials used so long as they are compatible with the specific use, as well as the contingent shapes and dimensions, may be any according to requirements and to the state of the art.

What is claimed is:

1. A nailing machine for assembling wood pallets comprising: at least one nailing station and advancement and guiding means which form a substantially horizontal resting surface at said nailing station, said nailing station being configured for the assembly of at least two superimposed wood pieces to be assembled by nailing to provide a pallet, said nailing station comprising at least one nailing head associated with at least one nailing stem, which can move along a substantially vertical direction with respect to said resting surface between an inactive position, in which the lower end of said at least one nailing stem is spaced from the upper surface of said at least two superimposed wood pieces, and an active position, in which the lower end of said nailing stem is moved closer to said upper surface of said at least two superimposed wood pieces, said at least one nailing head being feedable with the nails to be used for nailing, further comprising elevation variation means configured for varying the elevation of said upper surface of said two superimposed wood pieces at said nailing station, said means for varying the elevation of the upper surface being actuatable on command in order to move said upper surface to a predetermined elevation, wherein said elevation variation means comprise at least one upper abutment body for a portion of the upper surface of said two superimposed wood pieces, and at least one device for moving said resting surface configured to move on command said resting surface between a lowered position, in which the upper surface of said two superimposed wood pieces is spaced and located below said upper abutment body, and a raised position, in which said upper surface rests against said upper abutment body.

2. The nailing machine according to claim 1, wherein said device for moving said resting surface comprises at least one pneumatic actuation device.

3. The nailing machine according to claim 2, wherein said nailing station comprises at least one base structure, said at least one pneumatic actuation device being interposed between said resting surface and said base structure.

4. The nailing machine according to claim 1, wherein said at least one upper abutment body is connected kinematically to said at least one nailing stem during movement from the inactive position to the active position and from the active position to the inactive position.

5. The nailing machine according to claim 1, wherein said at least one upper abutment body is integral with said at least one nailing stem during movement from the inactive position to the active position and from the active position to the inactive position.

6. The nailing machine according to claim 1, wherein said upper abutment body comprises a fixed presser body.

7. The nailing machine according to claim 1, further comprising means for adjusting the force applied by said movement device during the transition from the lowered position toward the raised position.

* * * * *